United States Patent [19]

Kanzaka

[11] 4,133,082

[45] Jan. 9, 1979

[54] ADJUSTABLE FASTENING DEVICE

[75] Inventor: Yoshihiro Kanzaka, Nyuzen, Japan

[73] Assignee: Yoshida Kogyo K.K., Tokyo, Japan

[21] Appl. No.: 889,400

[22] Filed: Mar. 23, 1978

[30] Foreign Application Priority Data

Apr. 5, 1977 [JP] Japan ..... 52-42163[U]

[51] Int. Cl.[2] ..... A44B 21/00

[52] U.S. Cl. ..... 24/206 R

[58] Field of Search ..... 24/206 R

[56] References Cited

U.S. PATENT DOCUMENTS 1,908,231 5/1933 Freysinger ..... 24/206 R

FOREIGN PATENT DOCUMENTS

M21536 3/1956 Fed. Rep. of Germany ..... 24/206 R

*Primary Examiner*—Bernard A. Gelak

*Attorney, Agent, or Firm*—Hill, Gross, Simpson, Van Santen, Steadman, Chiara & Simpson

[57] ABSTRACT

There is disclosed an adjustable fastening device which comprises an adjustment belt and a slider. The adjustment belt includes a pair of rows of teeth arranged on the front face thereof perpendicularly thereto and legs projected from the back face thereof, and the slider comprises a body portion with a guide groove adapted to guide the belt therealong, and stopper member with claws formed on the back face thereof for engagement with the teeth of the adjustment belt is clippingly mounted on the body portion and is urged by an elastic member in a direction pulling the stopper member out of the body portion, and the adjustment belt is slidably fitted in the guide groove for it.

12 Claims, 18 Drawing Figures

ADJUSTABLE FASTENING DEVICE

BACKGROUND OF THE INVENTION (1) Field of the Invention

The present invention relates to an adjustable fastening device to be attached to a fastening portion. More particularly, the invention relates to the adjustable fastening device to be attached to a fastening portion of an article to be fastened, for example, a cap or an upper garment such as a windbreaker.

(2) Description of the Prior Art

As the slider of a conventional adjustable fastening device, there has been known two types of sliders, one of which comprises a clawed catch pivotably connected to the body portion of the slider and the other of which comprises a stopper pin inserted in a stepped lateral hole intersecting at a right angle a guide groove formed on the body portion of the slider and flanges mounted on both the ends of said pin to define and control the operation region of said pin in which said pin is arranged so that it can be engaged with a slender projection of an adjustment belt.

In the former type slider, a window hole is left opened on the top face of the body portion of the slider so as to permit the operation of a stopper claw, and in the latter type slider, the flanges of the stopper pin are protruded outside the body portion of the slider. Accordingly, in each of these conventional types of sliders, a part of an article to be fastened or other material is often caught in such a window hole or flange portion to inhibit the effect of stopping the slider. Further, in case of the latter slider, in order to prevent slippage of the stopper pin from the body portion of the slider, the flanges must be attached to both ends of the stopper pin and in order to keep the stopper pin anchored on the adjustment belt, the claw of the stopper pin is formed so that it is normally pressed on the top face of the adjustment belt. Accordingly, because of this normal pressing contact of the claw of the stopper pin with the adjustment belt, the sliding movement of the pin is not performed smoothly, and when the adjustment belt is composed of a synthetic resin, it is readily worn.

The present invention intends to provide an adjustable fastening device in which the foregoing disadvantages are eliminated.

SUMMARY OF THE INVENTION

It is a primary object of the present invention to provide an adjustable fastening device in which a slider can be automatically anchored on an adjustment belt by an elastic member having a spring action, the fitting portion of the slider to the adjustment belt can be operated assuredly without being disturbed by an article to be fastened or other material, and the slider can be assembled very easily.

Other objects of the present invention will become apparent from the detailed description given hereinafter.

In accordance with the fundamental aspect of the present invention, the foregoing and other objects can be attained by an adjustable fastening device, which comprises:

(a) an adjustment belt including rows of teeth arranged on the front face thereof perpendicularly thereto and legs projected from the back face of the adjustment belt; and (b) a slider including a body portion, a stopper member and an elastic member, said body portion including a guide groove adapted to guide the adjustment belt therealong, said adjustment belt being slidably fitted in said guide groove formed on the body portion of the slider, said stopper member having a substantially U-shaped cross-section and including claws formed on the back face thereof for engagement with the teeth of the adjustment belt, said stopper member being clippingly mounted on the body portion in such a manner as to slide relative thereto perpendicularly to the guide groove for the adjustment belt within a limited region to prevent said stopper member from escaping out of the body portion, and said stopper member being urged by said elastic member in a direction pulling the stopper member out of the body portion of the slider.

The present invention will now be described in detail by reference to the accompanying drawing.

DETAILED DESCRIPTION OF THE PREFERRED EMBODIMENTS

Figure 1:
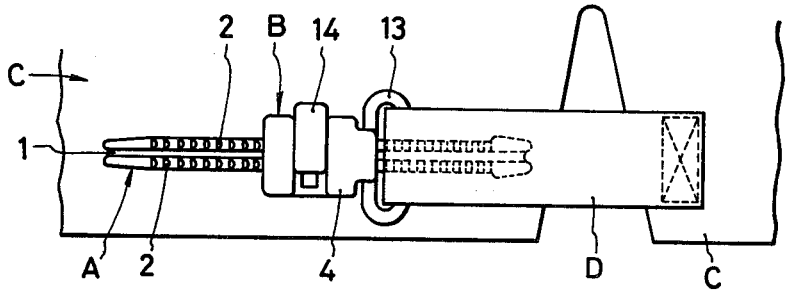
FIG. 1 is a front view of the adjustable fastening device according to the present invention in the state of being attached to an article to be fastened.

Referring to FIG. 1, an adjustment belt A is attached to one end of a first article C to be fastened, such as a cap, along a part of or entire length of the attachment belt A. A slider B is slidably fitted on the adjustment belt A and is connected to the other end of the first article C through a second article D to be fastened, such as a cloth or tape. In the embodiment shown in FIG. 1, a hanging stopper member 13 of the slider B is connected to one end of the second article D and the other end of the second article D is sewn to the other end of the first article C.

Figure 2:
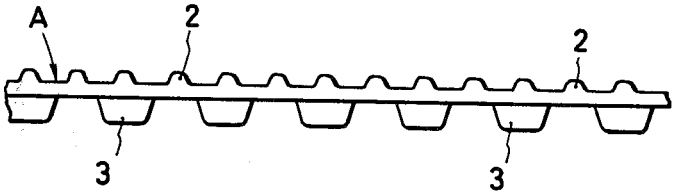
FIGS. 2-(*a*) and 2-(*b*) are side and front views, respectively, showing an adjustment belt.
Figure 2:
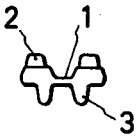
Figure 6:
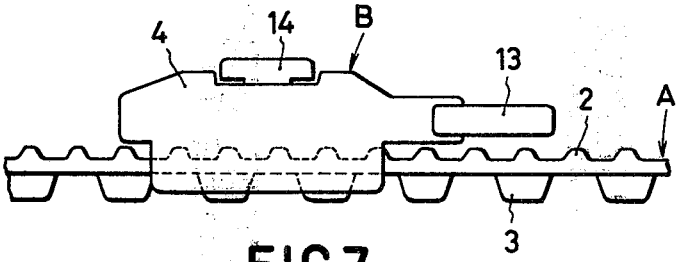
FIG. 6 is a side view showing the adjustable fastening device in the assembled state.
Figure 7:
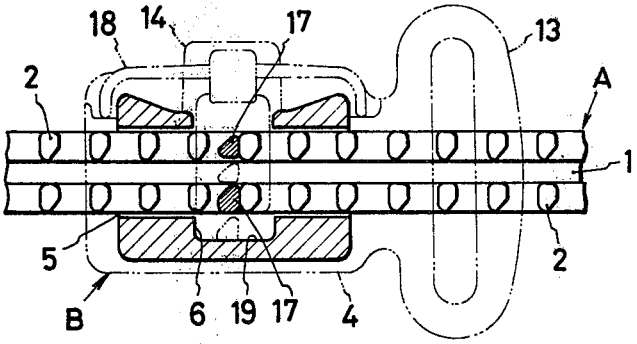
FIG. 7 is a front view of the fastening adjustment device, in which the front portion of the slider is omitted so as to show the engaging relation between claws of the stopper member and teeth of the adjustment belt.

Referring to FIG. 2, two parallel rows of teeth 2 are arranged on one of the surfaces or upper surface of the adjustment belt A to intersect the adjustment belt A substantially at right angles with respect to the longitudinal direction of the belt A. Formed along the longitudinal axis of the belt A is a concave groove 1 dividing the teeth 2 into the two parallel rows. As shown in FIGS. 6 and 7, the teeth 2 are to be engaged with claws 17 formed on a stopper member 14 of the slider B, and these claws 17 are allowed to slide in the concave groove 1. This concave groove 1 need not be disposed in the central portion of the adjustment belt A as shown in FIG. 2-(*b*), but such a groove may be on the side portion of the belt A and in some case, such groove may not be formed at all. In short, it is only required to arrange the belt A so that it is allowed to slide when the teeth 2 are disengaged from the claws 17.

Projected on the back surface of the adjustment belt A are legs 3 extending discontinuously in the longitudinal direction of the belt A. In FIG. 2-(*b*), the legs 3 are arranged in two rows. These legs 3 are disposed so that the slider B can slide smoothly on the adjustment belt A fixed onto the first article C. Accordingly, the legs 3 should be projected such a height from the back surface of the belt A that when the adjustment belt A is fitted to the slider B, the slider B is not allowed to have contact with the first article C. The shape of the legs 3 is not particularly critical but optional. When the adjustment belt A is required to have some flexibility, it is preferred that the legs 3 be arranged discontinuously in the longitudinal direction of the belt A as shown in FIG. 2-(*a*), and it is possible to dispose the legs 3 and lower legs alternately as in a crown if desired.

Figure 3:
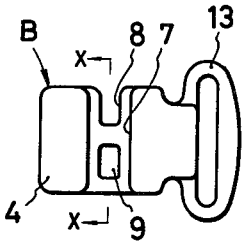
FIGS. 3-(*a*), 3-(*b*), 3-(*c*) and 3-(*d*) are a front veiw, a back view, a side view and a cross-section taken along line X—X in FIG. 3-(*a*), respectively, of the body portion of a slider.
Figure 3:
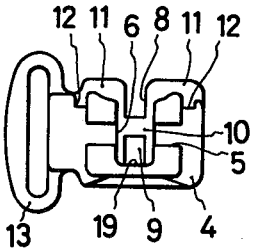
Figure 3:
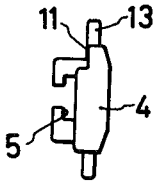
Figure 3:
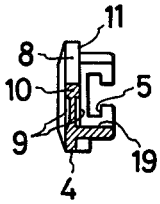
Figure 4:
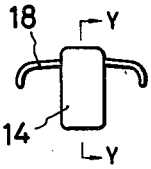
FIGS. 4-(*a*), 4-(*b*), 4-(*c*) and 4-(*d*) are a front view, a back view, a cross-section taken along line Y—Y in FIG. 4-(*a*) and a bottom view, respectively, of a stopper member.
Figure 4:
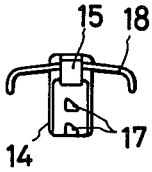
Figure 4:
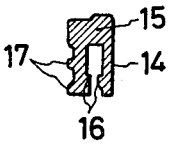
Figure 4:
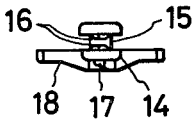

The slider B includes a body portion 4 shown in FIGS. 3-(*a*) to 3-(*d*) and a stopper member 14 and an elastic member 18 shown in FIGS. 4-(*a*) to 4-(*d*).

Referring to FIGS. 3-(*a*) to 3-(*d*), a guide groove 5 is formed on the back side of the body portion 4 of the slider B to guide the adjustment belt A. The shape of the guide groove 5 is not particularly critical so far as it has such configuration and size as will allow sliding of the adjustment belt A. In an embodiment shown in FIGS. 3-(*a*) and 3-(*b*), guide grooves 6 and 7 intersecting the guide groove 5 for the adjustment belt A substantially at right angles are formed on each face of the body portion 4 so that the stopper member 14 is inserted in these grooves 6 and 7. The guide groove 6 on the back side is extended from one lateral end face of the body portion 4 through the guide groove 5 for the adjustment belt A to an intermediate portion before the other lateral end face of the body portion 4, while the guide groove 7 on the front side is extended through the body portion 4 from one lateral end face to the other lateral end face. These guide grooves 6 and 7 are formed so that when the stopper member 14 is fitted into the body portion 4, lateral movement of the stopper member 14 is controlled. Other means may be used instead of these guide grooves 6 and 7 if this function can be attained. In general, the shapes of the guide grooves 6 and 7 are determined according to the shape and size of the stopper member 14.

A notch 8 is formed on the body portion 4 of the slider B at one end of the guide grooves for the stopper member 14 to provide communication between the back guide groove 6 and the front guide groove 7. As described hereinafter, the notch 8 is so shaped as to allow sliding movement of the stopper member 14. A pair of dents 9 and 9 are formed on the distal portions of the front and back grooves 6 and 7, and a thickened parts 10 are formed between one end of the dent 9 and the distal end of the notch 8. As described hereinafter, these dents 9 and thick parts 10 act as a stopper mechanism so that inner projections 16 of upper and lower pieces of the stopper member 14 are engaged with the dents 9 to prevent separation of the stopper member 14.

As shown in FIG. 3-(*b*), the back side part 11 of the body portion 4, which is adjacent to and on the opposite sides of the notch 8, is reduced in the thickness, and is on the same plane as that of the back guide groove 6 for the stopper member 14, and as shown in FIG. 3-(*c*), is lower than the bottom of the guide groove 5 for the adjustment belt A. Concavities 12 are formed on the side face of the body portion 4 on the notch 8 side and on both sides of the notch 8, as shown in FIG. 3-(*b*). As described hereinafter, these concavities 12 may support both the ends of the elastic member 16, when the elastic member 18 has a bow-like shape as shown in FIGS. 4-(*a*) to 4-(*d*). The body portion 4 has a relatively large loop portion 13 arranged at one end thereof to connect the second article D thereto. The shape of this loop portion 13 is not particularly critical but it optional. If desired, the loop portion 13 may have such a shape that it is directly fixed to the other end of the first article C, not through the second article D.

Referring to FIGS. 4-(*a*) to 4-(*d*) illustrating the stopper member 14, this stopper member 14 has a substantially U-shaped cross-section defined by a base 15 and upper and lower pieces interconnected to the base 15. As seen from FIGS. 4-(*a*) to 4-(*b*), projections 16 to be engaged with the above-mentioned dents 9 of the body portion 4 are formed on the distal ends of the confronting inner faces of the upper and lower pieces, and claws 17 to be engaged with the teeth 2 arranged on both sides of the adjustment belt A are projected from the back face of the stopper member 14, namely on the outer side face of the lower piece. The number of the claws 17 may be two as shown in FIGS. 4-(*b*) and 4-(*c*), but the number of the claws 17 is not particularly critical but it may be one or three or more. Namely, the number and shape of the claws 17 are appropriately determined depending on the shape and arrangement state of the teeth 2 on the front side of the adjustment belt A and on the presence or absence or shape of the concave groove 1.

The elastic member 18 is disposed on the base 15 of the stopper member 14 and it has a bow-like shape extending in opposite sides from the base 15. The bow-like elastic member 18 may be molded integrally with the base 15 or it may be prepared by fitting or fixing the base 15 with a bow-like or bow-shaped article separately prepared. This elastic member 18 is disposed to urge the stopper member 14 in a direction pulling the stopper member 14 out of the body portion 4.

Figure 5:
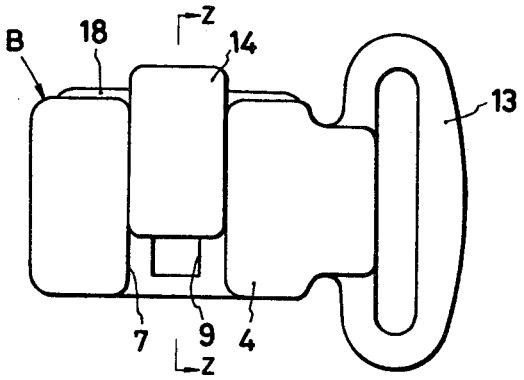
FIGS. 5-(*a*), 5-(*b*) and 5-(*c*) are a front view, a back view and a lateral cross-section taken along line Z—Z in FIG. 5-(*a*)
Figure 5:
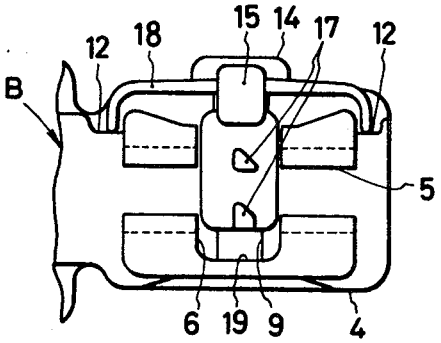
Figure 5:
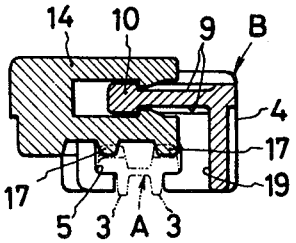

FIG. 5 illustrates the slider B including the body portion 4 shown in FIGS. 3-(*a*) to 3-(*d*) and the stopper member 14 and elastic member 18 shown in FIGS. 4-(*a*) to 4-(*d*). The stopper member 14 is inserted into the guide grooves 6 and 7 from the side of the notch 8 of the body portion 4. At this point, both the projections 16 of the stopper member 14 are caused to fall into snapping engagement with the dents 9 beyond the thickened part 10 in the body portion 4, whereby the stopper member 14 is fitted to the body portion 4 while catching the thickened part 10 therein. Both ends of the bow-like elastic member 18 are engaged with the convexities 12 of the body portion 4 so that the stopper member 14 is urged in a direction pulling the stopper member 14 out of the body portion 14.

The structure and operation of the adjustable fastening device of the present invention will now be described by reference to FIGS. 6 and 7.

The adjustment belt A is fitted in the guide groove 5 of the slider B, and the slider B is so arranged that it can slide on the adjustment belt A. When the stopper member 14 is in the state where it is urged by the elastic member 18 in a direction pulling the stopper member 14 out of the body portion 4, since the claws 17 are engaged with the teeth 2 of the adjustment belt A, the slider B is kept in the state where it is not allowed to slide on the adjustment belt A. On the other hand, when the stopper member 14 is pushed deeply into the body portion 4 against the aforementioned urging force of the elastic member 18, the distal end of the lower piece of the stopper member 14 is caused to bear against the end face 19 of the back guide groove 6 for the stopper member 14. Accordingly, the intrusion range of the stopper member 14 is controlled and simultaneously, the claws 17 are disengaged from the teeth 2 as shown by the dotted line in FIG. 7 and the slider B is allowed to slide on the adjustment belt A. Of course, dimentions may be modified so that the slider B is allowed to slide on the adjustment belt A, before the lower piece of the stopper member 14 reaches the end face 19 of the guide groove 6.

Figure 8:
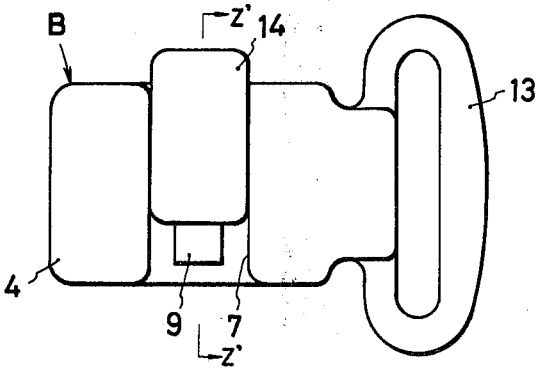
FIGS. 8-(*a*) and 8-(*b*) illustrate another preferred embodiment of the invention, and are respectively a front view and a lateral cross-section taken along line Z'—Z' in FIG. 8-(*a*).
Figure 8:
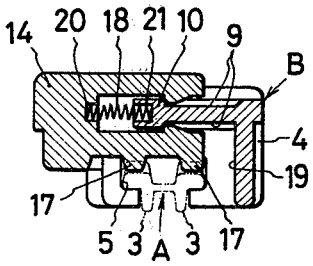

FIG. 8 illustrates another embodiment of the slider B of the adjustable fastening device of the present invention. In the slider shown in FIG. 8, a coil spring is used as the elastic member 18. More specifically, the coil spring acting as the elastic member 18 is located between the inner face of the base 15 of the stopper member 14 and the thickened part 10 of the body portion 4. In this embodiment, hollows 20 and 21 for determining the position of the coil spring may be formed on the base 15 and thickened part 10 against which both ends of the coil spring bear, respectively. When the coil spring is used as the elastic member 18, the convexities 12 need not be formed on the body portion 4 for engagement with the bow-like elastic member 18 as shown in FIG. 3-(*b*). Thus, optional means or members may be used as the elastic member 18 so far as the above-mentioned function of urging the stopper member 14 in a direction pulling the stopper member 14 out of the body portion 4 is attained.

Each of the adjustment belt A and slider B constituting the adjustable fastening device of the present invention may be formed of an optional material, but they are conveniently molded from synthetic resin. In general, an apropriate material is chosen and used according to the kind of an article to be fastened. For example, when the article to be fastened is a cap or the like, the adjustment belt A is required to be composed of a flexible material.

In the adjustable fastening device of the present invention having the above-mentioned structure, if the stopper member 14 is deeply pushed into the body portion 4 against the urging force of the elastic member 18, the claws 17 are released from the engagement with the teeth 2 and the slider B is allowed to slide on the adjustment belt A along the longitudinal direction thereof. When this pushing force is removed from the stopper member 14, the stopper member 14 is returned to the original position by the resiliency of the elastic member 18, and the claws 17 fall into engagement with the teeth 2 and this engagement is stably maintained.

As will be apparent from the foregoing illustration, the adjustable fastening device of the present invention comprises the adjustment belt having rows of teeth arranged on the front side thereof and the slider including a body portion, the stopper member and the elastic member, which is fitted on the adjustment belt. Further, the stopper member is formed to have the substantially U-shaped cross-section and it has claws formed on the back side thereof, and this stopper member is arranged to catch therein the body portion so that it can slide in a limited region in a direction intersecting an adjustment belt-guiding belt substantially at a right angle and the stopper member is urged by the elastic member in a direction pulling the stopper member out of the body portion. By virtue of the foregoing structural characteristics, in the adjustable fastening device of the present invention, the slider can be automatically anchored on the adjustment belt, and since the stopper member having a substantially U-shaped cross-section is arranged to catch therein the body portion of the slider, assembling of the slider can be remarkably facilitated. Moreover, since the fitting portion of the slider to the adjustment belt is located in the interior of the body portion of the slider and there is no fear of catching of an article to be fastened or other material into this fitting portion, stopping of the slider and release of the slider from stopping can always be accomplished very assuredly.

What is claimed is:

1. An adjustable fastening device, which comprises:

(a) an adjustment belt including rows of teeth arranged on the front face thereof perpendicuarly thereto and legs projected from the back face of the adjustment belt, and (b) a slider comprising a body portion, a stopper member and an elastic member; said body portion including a guide groove adapted to guide the adjustment belt therealong, said adjustment belt being slidably fitted in said guide groove formed on the body portion of the slider, said stopper member having a substantially U-shaped cross-section and including claws formed on the back face thereof for engagement with the teeth of the adjustment belt, said stopper member being clippingly mounted on the body portion in such a manner as to slide relative thereto perpendicularly to the guide groove for the adjustment belt within a limited region to prevent said stopper member from escaping out of the body portion, and said stopper member being urged by said elastic member in a direction pulling the stopper member out of the body portion of the slider.

2. An adjustable fastening device as set forth in claim 1, wherein a concave groove is formed on the gront face of the adjustment belt along the longitudinal direction thereof.

3. An adjustable fastening device as set forth in claim 1, wherein the concave groove is formed along the longitudinal axis of the adjustment belt.

4. An adjustable fastening device as set forth in claim 1, wherein the legs on the back face of the adjustment belt are arranged discontinuously in the longitudinal direction of the adjustment belt.

5. An adjustable fastening device as set forth in claim 1, wherein a pair of guide grooves for the stopper member are formed on each face of the body portion of the slider, said pair of guide grooves intersecting the guide groove for the adjustment belt substantially at right angles.

6. An adjustable fastening device as set forth in claim 5, wherein the guide groove on the front face of the body portion of the slider is formed to extend along the entire length between both the lateral end faces of the body portion and the guide groove on the back face of the body portion of the slider if formed to extend from one lateral end face of the body portion through the guide groove for the adjustment belt to an intermediate portion before the other lateral end face of the body portion.

7. An adjustable fastening device as set forth in claim 5, wherein a notch is formed on the body portion of the slider at one ends of the guide grooves for the stopper member to provide communication between the front and back guide grooves.

8. An adjustable fastening device as set forth in claim 5, wherein a dent or thickened part is formed on the terminal end of at least one of said front and back guide grooves formed on the body portion of the slider to engage the stopper member therewith.

9. An adjustable fastening device as set forth in claim 7, wherein convexities are formed on the side face of the body portion of the slider on the notch side and on both sides of the notch.

10. An adjustable fastening device as set forth in claim 1, wherein the stopper member has a substantially U-shaped cross-section defined by a base and upper and lower pieces connected thereto and projections to be engaged with the body portion are formed on the inner faces of the top ends of the upper and lower pieces.

11. An adjustable fastening device as set forth in claim 1, wherein the elastic member has a bow-like shape extended in opposite sides from the base portion of the stopper member and formed integrally with the base portion of the stopper member.

12. An adjustable fastening device as set forth in claim 1, wherein the elastic member is a spring coil.

* * * * *